United States Patent [19]

Hoeh, deceased

[11] 4,147,947

[45] Apr. 3, 1979

[54] FLUORESCENT LAMP WITH INTEGRAL THERMAL-INSULATING PLASTIC JACKET

[75] Inventor: Frederick W. Hoeh, deceased, late of Livingston, N.J., by Inga Hoeh, personal representative

[73] Assignee: Westinghouse Electric Corp., Pittsburgh, Pa.

[21] Appl. No.: 873,816

[22] Filed: Jan. 31, 1978

[51] Int. Cl.[2] ..... H01J 61/42; H01J 61/52

[52] U.S. Cl. ..... 313/27; 313/44; 313/312; 313/493

[58] Field of Search ..... 313/485, 312, 493, 44, 313/27, 489, 317; 264/272; 362/223

[56] References Cited

U.S. PATENT DOCUMENTS

| | | | |
|---|---|---|---|
| 2,131,888 | 10/1938 | Harris | 313/27 X |
| 3,093,448 | 6/1963 | Kirkpatrick et al. | 264/272 |
| 3,426,234 | 2/1969 | Hayasaka et al. | 313/312 |
| 3,808,495 | 4/1974 | Win | 313/312 X |

*Primary Examiner*—Palmer C. Demeo
*Attorney, Agent, or Firm*—D. S. Buleza

[57] ABSTRACT

The light output of a fluorescent lamp is improved under cold temperature operating conditions by enclosing the envelope in a jacket of light-transmitting plastic material that has a plurality of air pockets or bubbles formed therein. The pockets of entrapped air collectively function as a thermal blanket for the envelope which conserves the heat produced by the lamp during operation without obstructing the generated light rays. The "thermo-bubble" jacket is preferably fabricated from flexible two-ply plastic so that it can also serve as a lightweight protective component for the lamp when it is packed with other jacketed lamps in a shipping container.

12 Claims, 7 Drawing Figures

FLUORESCENT LAMP WITH INTEGRAL THERMAL-INSULATING PLASTIC JACKET

BACKGROUND OF THE INVENTION

1. Field of the Invention

This invention relates to electric lamps and has particular reference to an improved fluorescent lamp unit that is adapted for use in low temperature environments.

2. Description of the Prior Art.

Fluorescent lighting assemblies having integral enclosures or jackets that physically protect and thermally insulate the fragile lamp envelope are well known in the art. A lighting unit of this type having a tubular jacket or shield of rigid plastic that is held in spaced-apart enclosing relationship with the lamp envelope by a pair of resilient annular support members that are slipped over the ends of the lamp and effect a force fit with the adjacent ends of the shield is disclosed in U.S. Pat. No. 3,124,307 issued Mar. 10, 1964 to T. E. Hoskins et al. In a more recent design, a rigid open-ended plastic sleeve is held in enclosing and insulating relationship with the glass envelope of a fluorescent lamp by slipping the sleeve over a pair of rubber grommets that are placed on and compressively grip the ends of the envelope. A fluorescent lamp unit constructed in this fashion is disclosed in U.S. Pat. No. 3,720,826 issued Mar. 13, 1973 to J. F. Gilmore et al.

A fluorescent lamp having an insulating tubular jacket composed of rigid oriented plastic material that is secured to the lamp by shrinking the ends of the tubular jacket so that they grip the lamp, or which is made of glass and is held in place by a pair of overlapping shrunk plastic sleeves, is described in U.S. Pat. No. 3,602,759 issued Aug. 31, 1971 to G. S. Evans.

While the tubular shield and jacket assemblies of the prior art protected the glass envelopes of the fluorescent lamps from accidental breakage and the detrimental effects of cold ambient temperatures, they are rather expensive and create production problems since they require specially-molded supporting components or gaskets and several time-consuming operations to force-fit the various components together in operative relationship with the lamp.

SUMMARY OF THE INVENTION

The foregoing disadvantages are eliminated in accordance with the present invention by fabricating the protective-insulating shield of jacket from transparent plastic that has a plurality of air bubbles or pockets distributed throughout the plastic material. Such "bubble" plastic is generally made by laminating two piles of plastic together in such a fashion that a series of sealed cavities or pockets filled with entrapped air is formed. The air pockets are so spaced and configured that they provide a plastic insulating "blanket" which is very flexible, resilient and lightweight.

In accordance with a preferred embodiment, a rectangular piece of such "bubble" plastic material is wrapped around the tubular envelope of a conventional fluorescent lamp and the abutting edges of the plastic material are joined by a piece of transparent adhesive tape to provide a jacket that is secured in snug-fitting enclosing relationship with the lamp envelope. The lamp is thus encapsulated by a plastic cover or sheath which surrounds it with entrapped air and conserves the heat generated within the envelope when the lamp is operated. This, in turn, permits the lamp to be used in cold environments such as refrigerators and the like without exhibiting the drastic loss of light output which would normally occur under such operating conditions. In addition, the "thermo-bubble" jacket is very inexpensive, can easily be assembled with and secured to the fluorescent lamp and can even serve the additional function of a protective container which prevents the glass envelope from becoming damaged or broken during shipment when the lamp is placed in a carton along with similarly jacketed lamps.

BRIEF DESCRIPTION OF THE DRAWING

A better understanding of the invention will be obtained from the exemplary embodiment shown in the accompanying drawing, wherein.

DESCRIPTION OF THE PREFERRED EMBODIMENTS

Figure 1:
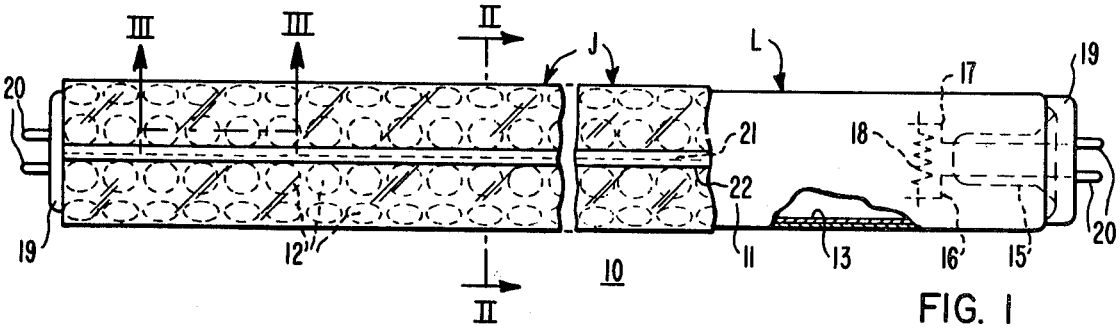
FIG. 1 is a side elevational view of a jacketed fluorescent lamp unit embodying the invention, a portion of the thermal-insulating plastic jacket being removed to illustrate the lamp components.

An improved lighting unit 10 embodying the present invention is shown in FIG. 1 and consists of an electric lamp L which has a sealed envelope 11 of suitable light-transmitting vitreous material that is covered by a snug-fitting sleeve or jacket J of light-transmitting plastic material. The jacket has a plurality of spaced bubbles or pockets 12 formed therein which are sealed and filled with entrapped air and thus thermally insulate the envelope.

While the lamp L can be any type of electric lamp which has an operating bulb-wall temperature that will not char or otherwise damage the plastic jacket J, the invention is particularly adapted for use in conjunction with discharge lamps of the low-pressure variety such as fluorescent lamps and has accordingly been so illustrated and will be so described. The envelope 11 is thus of tubular elongated configuration, is composed of glass and has its inner surface coated with a layer 13 of a suitable phosphor that emits light when excited by the ultraviolet radiations produced within the fluorescent lamp 10 when it is energized and in use. In accordance with standard lamp-making practice, each end of the envelope 11 is closed by a glass stem 15 that is fused to the rim of the envelope and includes a pair of lead-in wires 16, 17 which support a thermionic electrode 18 and extend into a suitable base 19 that is attached to the sealed ends of the envelope. The lead wires 16, 17 are connected to a pair of suitable terminals such as a pair of metal pins 20 that are anchored in the respective base members 19. The envelope 11 contains a suitable fill gas, such as several torr of argon or the like, and a measured dose of mercury which are introduced into the envelope in the customary fashion before it is hermetically sealed.

As will be noted in FIG. 1, the thermal-insulating jacket J extends along the entire length of the lamp envelope 11 and, according to this embodiment, is formed from a single rectangular piece of "bubble-plastic" material that is flexible and wrapped around the envelope so that it completely covers it. The longitudinal edges of the plastic material are in substantially abutting relationship and form a seam 21 which is covered by a piece of transparent plastic adhesive tape 22, thus joining the edges of the plastic material together and securing the jacket J in snug-fitting relationship with the envelope 11.

Figure 2:
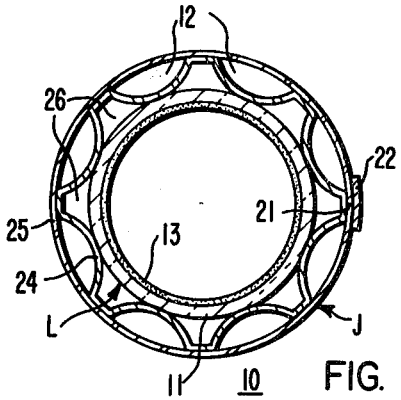
FIG. 2 is an enlarged cross-sectional view of a jacketed part of the lamp unit, along the line II—II of FIG. 1.
Figure 3:
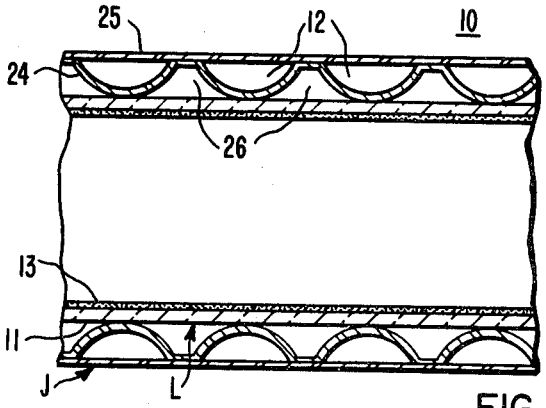
FIG. 3 is an enlarged fragmentary sectional view of the lamp unit in an axial direction, along line III—III of FIG. 1.

As illustrated in FIGS. 2 and 3, the thermal jacket J is preferably fabricated from two laminated layers or plies 24 and 25 of a suitable clear plastic (such as polyvinyl chloride polyethylene, laminated polypropylene or a suitable ionomer type plastic resin which is marketed by the E. I. duPont de Nemours and Company under the trade name "Surlyn" plastic material) that will withstand the temperatures to which the envelope 11 is heated during lamp operation. The inner ply 24 is distended in selected areas and bonded or otherwise secured to the outer ply 25 at other regions in such a manner that a series of protruding air bubbles or pockets 12 are provided that are distributed in a predetermined pattern or array. The light-transmitting jacket J is thus composed of a pliable or flexible plastic material that has a smooth outer surface and a series of protruding arcuate air pockets 12 on its inner surface with the tips or crests of the pockets pressed against the outer surface of the envelope 11. The thermal-insulating properties of the jacket J are enhanced by the fact that the spaces between the air pockets 12 constitute a network of sealed-off cavities 26 that are also filled with entrapped air. The envelope 11 is thus surrounded by a "blanket" of entrapped air.

While the air pockets 12 employed in the illustrated embodiment are of circular configuration and generally hemispherical in cross section and aligned with one another in both directions, they obviously can be of various shapes and sizes and can also be arranged in different patterns and arrays. As a specific example, satisfactory thermal-insulation was obtained in the case of a conventional 40 watt fluorescent lamp approximately 122 centimeters long having a tubular (T12 type) envelope 38 millimeters in diameter by wrapping the envelope in a two-ply jacket of transparent plastic having uniformly-spaced circular air pockets approximately 10 millimeters in diameter and of such height that the overall thickness of the plastic material was approximately 6 millimeters. Comparative cold temperatures tests have shown that at an ambient temperature of 35° F. (1.67° C.) the jacketed lamp had a light output which was 39% greater than that of an unjacketed lamp of the same wattage and construction. At an ambient temperature of 40° F. (4.44° C.), the jacketed lamp exhibited a 30% increase in light output.

Other tests with 40 watt type fluorescent lamps have indicated that such jacketed lamps operate with peak output at an ambient temperature range of from about 40° to 45° F. (about 4° to 7° C.) compared to a bare lamp of the same type which requires an ambient temperature of about 75° F. (about 24° C.) for peak output. Fluorescent lamps provided with such flexible plastic thermal-insulating jackets are thus especially adapted for use in referigerators and the like which require ambient temperatures in this range.

As will be obvious to those skilled in the art, the invention is not limited to conventional 40 watt type fluorescent lamps but can be advantageously employed on other sizes and kinds of fluorescent lamps including the socalled Slimline type and those designed for operation at high power loadings.

In the case of 40 watt fluorescent lamps that conventionally employ a T12 type envelope 1½ inches (38 mm.) in diameter, it might be desirable to use an envelope of slightly smaller size (a T10 envelope 1¼ inches or about 32 mm. in diameter, for example) to maintain the overall girth of the jacketed lamp somewhat comparable to conventional unjacketed 40 watt lamps now being marketed.

It will also be appreciated that the plastic-bubble jacket J can be made in one piece without any seams and that jackets having seams can have their abutting edges joined by other means besides transparent plastic adhesive tape. For example, one edge of the pocketed plastic material can be provided with an integral plastic flap or tab that can be heat sealed or cemented to the other edge of the plastic covering, or a zipper-like fastener can be used along the seam to provide a "bubble-plastic" type insulating jacket that can be removed when the lamp has reached the end of its useful life and then be reused on a new lamp.

Figure 4:
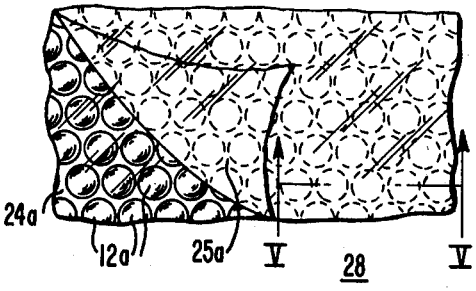
FIG. 4 is a plan view of an alternative type of lamp-jacketing plastic material, a portion of the "facing" ply being peeled back for illustrative purposes.
Figure 5:
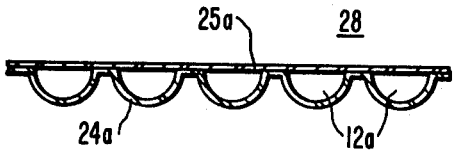
FIG. 5 is an enlarged cross-sectional view through a portion of the alternative lamp-jacketing material, along line V—V of FIG. 4.

The size and orientation of the air pockets can also be changed as desired to obtain different degrees of insulation. An alternative "bubble-plastic" jacket material 28 illustrating these features is shown in FIGS. 4 and 5. As shown, the outer surface of the modified flexible thermal-insulating covering 28 is smooth and defined by the outer ply **25*a* of plastic which seals off protruding small-diameter pockets 12*a* that are defined by the inner ply 24*a* and extend from the other face of the plastic material. As will be noted in FIG. 4, the air bubbles or pockets 12*a*** are much smaller in size (5 mm. diameter, for example) and more closely spaced. They are also distributed in staggered interlocking array in contrast to the aligned row-on-row pattern employed in the previously described embodiment.

Figure 6:
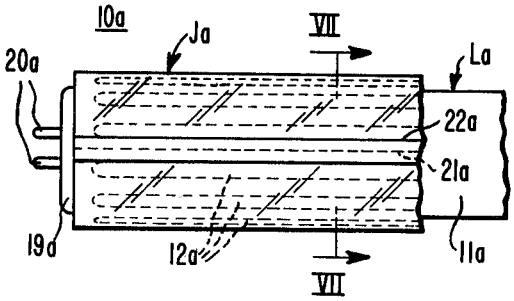
FIG. 6 is a side elevational view of a portion of an alternative fluorescent lamp unit having a plastic insulating jacket with elongated air pockets; and, FIG. 7 is an enlarged cross-sectional view of the alternative lamp unit, along line VII—VII of FIg. 6.
Figure 7:
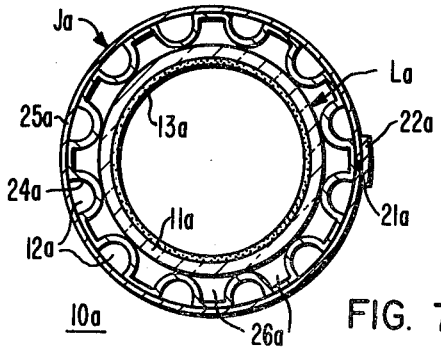

Insulating plastic jackets having elongated rather than circular pockets can also be employed. An alternative lamp unit **10*a* having such a jacket Ja is shown in FIGS. 6 and 7. As illustrated, the lamp La consists of a double-ended fluorescent lamp (only a portion of which is shown) that has a tubular glass envelope 11*a* that is enclosed by a two-ply plastic jacket Ja which is formed in such a manner that a plurality of elongated rib-like air pocekts 12*a* extend along the envelope with the crests of the pockets pressed against the bulb wall. The envelope 11*a* is coated with phosphor 13*a* and terminated at each end with the usual base 19*a* and terminal components 20*a***.

The elongated air pockets **12*a* are defined by the inner ply 24*a* of plastic and terminated inwardly from the end edges of the jacket Ja to preserve the integrity of the pockets. The seam 21*a* of the plastic material is closed by suitable means such as plastic tape 22*a* and, in order to seal off the network of longitudinal cavities 26*a* between the rib-like pockets 12*a*, strips of such tape (not shown) can also be secured to the bases 19*a* in overlapped relationship with the associated ends of the jacket Ja. If desired, color modification of the light generated by the lamp La can be achieved by making the outer ply 25a** (or both plies) from color-tinted plastic.

In addition to providing excellent thermal insulation for the electric lamp, the preferred "bubble-plastic" jackets which embody the invention are also very flexible and resilient and thus have outstanding shock-absorbing characteristics. They can, accordingly, serve the dual function of a protective sheath or container for fluorescent and other types of lamps which will prevent the fragile glass envelopes from being damaged or broken when the lamp is placed in a shipping carton along with other jacketed lamps.

I claim as my invention:

1. An electric lamp comprising, in combination;

a sealed light-transmitting envelope of elongated configuration that contains means for generating visible radiation when the lamp is energized, and means for thermally insulating at least a portion of said envelope comprising a covering of light-transmitting material that has a plurality of sealed pockets therein and is secured in overlying encircling relationship with the envelope, said pockets being defined by locally distended portions of said covering material and disposed in a predetermined array throughout the material.

2. A low-pressure electric discharge lamp comprising, in combination;

a sealed light-transmitting envelope of vitreous material that contains spaced electrodes and ionizable means adapted to initiate and sustain an electric discharge when the lamp is energized, and a covering of light-transmitting plastic material secured in overlying relationship with at least a portion of said envelope, said covering of plastic material having a plurality of sealed air pockets therein which are defined by locally distended parts of the plastic material and are so distributed that they collectively constitute a blanket of thermal insulating elements for the covered portion of said lamp.

3. The low-pressure discharge lamp of claim 2 wherein;

said envelope is of elongated configuration, and said thermal-insulating covering of pocketed plastic material extends around and along substantially the entire length of said envelope and thus comprises a jacket that substantially encloses the envelope.

4. The low-pressure discharge lamp of claim 2 wherein said thermal-insulating covering comprises two plies of flexible plastic material that are secured to one another along regions such that one face of said covering is substantially smooth and its other face is distended and defines an array of said air pockets.

5. The low-pressure discharge lamp of claim 2 wherein said air pockets protrude from the same face of the plastic covering material and are disposed toward and are in contact with the lamp envelope.

6. The low-pressure discharge lamp of claim 5 wherein said air pockets are of such configuration that the protruding portions of said plastic covering material, together with the associated outer surface of said envelope and the non-protruding portions of said covering material, define a network of sealed-off interpocket cavities that are also filled with entrapped air and thus enhance the thermal-insulating effectiveness of the plastic covering material.

7. The low-pressure discharge lamp of claim 2 wherein;

said envelope is of tubular elongated configuration and is composed of glass, has an inner coating of phosphor, and contains a fill gas and mercury and said lamp thus comprises a fluorescent lamp, and said thermal-insulating covering of plastic material is flexible and comprises a snug-fitting jacket that extends along substantially the entire length of said envelope.

8. The fluorescent lamp of claim 7 wherein;

said thermal-insulating jacket is fabricated from two laminated plies of flexible plastic, one of which is distended and defines said air pockets, and the two-ply plastic material is so oriented that the face of the jacket having the protruding air pockets is disposed toward and in contact with the lamp envelope.

9. The fluorescent lamp of claim 7 wherein;

said thermal-insulating jacket is fabricated from a single piece of flexible air-pocketed plastic material that has one substantially smooth face and is wrapped around the lamp envelope with the smooth face of the plastic material disposed outwardly and its longitudinal edges disposed adjacent one another and defining a seam, and said plastic jacket is held in envelope-enclosing relationship with the lamp by means which extends along said seam and joins the longitudinal edges of the plastic material.

10. The fluorescent lamp of claim 7 wherein;

said thermal-insulating jacket is fabricated from flexible plastic material that has the air pockets protruding from one face thereof with said air pockets being disposed in predetermined spaced-apart array, and said air pockets are of uniform size and configuration and are disposed toward and are in contact with the lamp envelope.

11. The fluorescent lamp of claim 10 wherein;

said air pockets are of arcuate configuration with convex profiles the crests whereof are in pressured engagement with the lamp envelope, and the outer surface of the said plastic jacket is substantially smooth.

12. The fluorescent lamp of claim 10 wherein said air pockets are of elongated rib-like configuration and extend along the lamp envelope.

* * * * *